US011729894B2

(12) United States Patent
Friedemann et al.

(10) Patent No.: US 11,729,894 B2
(45) Date of Patent: Aug. 15, 2023

(54) X-RAY TUBE RECEPTACLE

(71) Applicant: Baker Hughes Oilfield Operations LLC, Houston, TX (US)

(72) Inventors: Reinhard Friedemann, Rodenberg (DE); Farid Aslami, Wunstorf (DE); Andreas Schmitt, Wunstorf (DE)

(73) Assignee: Baker Hughes Oilfield Operations LLC, Houston, TX (US)

( * ) Notice: Subject to any disclaimer, the term of this patent is extended or adjusted under 35 U.S.C. 154(b) by 218 days.

(21) Appl. No.: 17/114,849

(22) Filed: Dec. 8, 2020

(65) Prior Publication Data

US 2022/0183135 A1 Jun. 9, 2022

(51) Int. Cl.

| | |
|---|---|
| ***H05G 1/06*** | (2006.01) |
| ***H05G 1/10*** | (2006.01) |
| ***H05G 1/26*** | (2006.01) |
| ***H05G 1/30*** | (2006.01) |

(52) U.S. Cl.

CPC ..... *H05G 1/06* (2013.01); *H05G 1/10* (2013.01); *H05G 1/26* (2013.01); *H05G 1/30* (2013.01)

(58) Field of Classification Search

CPC ..... H05G 1/06; H05G 1/10

See application file for complete search history.

(56) References Cited

U.S. PATENT DOCUMENTS

| | | | | |
|---|---|---|---|---|
| 3,808,559 | A * | 4/1974 | MacLachlan | H05G 1/02 327/301 |
| 2013/0163725 | A1* | 6/2013 | Hansen | H01R 13/533 378/101 |
| 2019/0074154 | A1* | 3/2019 | Woodman | H01J 35/14 |
| 2020/0068692 | A1* | 2/2020 | Ernest | H05G 1/06 |
| 2020/0253033 | A1* | 8/2020 | Li | H02M 7/10 |

* cited by examiner

*Primary Examiner* — Chih-Cheng Kao

(74) *Attorney, Agent, or Firm* — Mintz Levin Cohn Ferris Glovsky and Popeo, P.C.

(57) ABSTRACT

An apparatus including an X-ray tube is provided. The X-ray tube can include a cathode and an input receptacle coupled to the cathode. The input receptacle can include a connector configured within the input receptacle. The connector can operatively couple the cathode and the input receptacle. The connector can include at least one circuit configured to receive an input signal via the input receptacle. The input signal can be between 20 kV and 400 kV. The input signal can be received as an auxiliary supply voltage. The at least one circuit can be configured to generate an output signal indicative of at least one operational characteristic of the X-ray tube. Related systems, and methods of use are also provided.

18 Claims, 6 Drawing Sheets

X-RAY TUBE RECEPTACLE

BACKGROUND

X-ray tubes can be configured with a receptacle by which input voltage can be supplied to a cathode of the X-ray tube causing the cathode to emit radiative energy as X-rays. The receptacle described herein can include an inner volume in which electrical components can be located. The receptacle electronics can be configured to control one or more aspects of the X-ray tube and can enable diagnostic analysis of X-ray tube operation.

SUMMARY

In one aspect, an apparatus is provided. In one embodiment, the apparatus can include a X-ray tube including a cathode and an input receptacle coupled to the cathode. The input receptacle can include a connector configured within the input receptacle. The connector can operatively couple the cathode and the input receptacle. The connector can include at least one circuit configured to receive an input signal via the input receptacle. The input signal can be received as an auxiliary supply voltage. The at least one circuit can be configured to generate an output signal indicative of at least one operational characteristic of the X-ray tube.

In another embodiment, the connector can be configured for insertion into and removal from an inner volume of the input receptacle. In another embodiment, the X-ray tube is a bipolar X-ray tube. In another embodiment, at least one operational characteristic of the X-ray tube can include a filament temperature, a filament current, an electron emission current, or at least one parameter associated with a beam shape emitted by the X-ray tube.

In another embodiment, the connector can include a transceiver configured to establish a communication channel between the connector and a data processor of a computing device coupled to the connector via the communication channel. The transceiver can be powered by a portion of the auxiliary supply voltage. In another embodiment, the data processor can be configured to determine a tube setting associated with the at least eon operational characteristic of the X-ray tube. The tube setting can correspond to a tube-identifier setting stored in a memory of the computing device. The data processor can be configured to transmit the determined setting to a controller coupled to the data processor and to a voltage generator coupled to the input receptacle, which can cause the controller to control the voltage generator to provide at least one of an input voltage to the cathode, or a heating current to the cathode based on the determined setting of the X-ray tube.

In another embodiment, the input signal can be between 20 kV and 400 kV.

In another aspect, a system is provided. In one embodiment, the system can include an X-ray tube including a cathode and an input receptacle coupled to the cathode. The input receptacle can include a connector configured within the input receptacle. The connector can operatively couple the cathode and the input receptacle. The connector can include at least one circuit configured to receive an input signal via the input receptacle. The input signal can be received as an auxiliary supply voltage. The at least one circuit can be configured to generate an output signal indicative of at least one operational characteristic of the X-ray tube. The connector can also include a transceiver configured to transmit the output signal generated via the at least one circuit. The system can also include a computing device operatively coupled to the connector via a communication channel established by the transceiver. The computing device can include at least one data processor, and a memory storing instructions. The instructions, when executed by the at least one data processor cause the at least one data processor to perform operations including receiving data characterizing the output signal. The instructions further cause the at least one data processor to determine, based on the received data, at least one operational characteristic of the X-ray tube. The instructions further cause the at least one data processor to provide the at least one operational characteristic of the X-ray tube.

In another embodiment, the transceiver is powered by a portion of the auxiliary supply voltage. In another embodiment, at least one operational characteristic of the X-ray tube can include a filament temperature, a filament current, an electron emission current, or at least one parameter associated with a beam shape emitted by the X-ray tube. In another embodiment, the at least one operational characteristic can be provided in a graphical user interface of a display coupled to the data processor. In another embodiment, the input signal can be between 20 kV and 400 kV.

In another aspect, a method is provided. In one embodiment, the method can include receiving, by a data processor, data characterizing an output signal generated via at least one circuit located on a connector configured within an input receptacle of an X-ray tube. The connector can operatively couple a cathode of the X-ray tube to the input receptacle. The at least one circuit can be configured to receive an input signal via the input receptacle. The input signal can be received as an auxiliary supply voltage. The at least one circuit can also be configured to generate the output signal indicative of at least one operational characteristic of the X-ray tube. The method can also include determining, by the data processor and based on the received data, at least one operational characteristic of the X-ray tube. The method can further include providing, by the data processor, the at least one operational characteristic of the X-ray tube.

In another embodiment, the connector can be configured for insertion into and removal from an inner volume of the input receptacle. In another embodiment, the X-ray tube is a bipolar X-ray tube. In another embodiment, the at least one operational characteristic of the X-ray tube includes a filament temperature, a filament current, an electron emission current, or at least one parameter associated with a beam shape emitted by the X-ray tube.

In another embodiment, the connector can include a transceiver configured to establish a communication channel communicably coupling the connector and the data processor. The transceiver can be powered by a portion of the auxiliary supply voltage. In another embodiment, responsive to providing the at least one operational characteristic indicative of a tube-type identifier corresponding to a type of X-ray tube, the method can also include determining, by the data processor, a tube setting corresponding to the tube-type identifier, and transmitting, by the data processor, the tube setting to a controller coupled to the data processor and to a voltage generator coupled to the input receptacle. When received, the controller controls the voltage generator to provision at least one of an input voltage to the cathode or a heating current to the cathode based on the determined tube setting.

In another embodiment, the input signal is between 20 kV and 400 kV. In another embodiment, the at least one operational characteristic is provided in a graphical user interface provided in a display coupled to the data processor.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

These and other features will be more readily understood from the following detailed description taken in conjunction with the accompanying drawings, in which.

It is noted that the drawings are not necessarily to scale. The drawings are intended to depict only typical aspects of the subject matter disclosed herein, and therefore should not be considered as limiting the scope of the disclosure.

DETAILED DESCRIPTION

Determining an operation of an X-ray tube can require external components to be coupled to internal components of the X-ray tube, such as a cathode of the X-ray tube, in order to measure diagnostic data indicative of the operation of the X-ray tube. Often X-ray tube applications may not permit or can be difficult to enable such coupling due to size or space constraints within the X-ray tube or the application environment in which the X-ray tube is operating.

In addition, the use of various wires to couple the X-ray tube or components therein to monitoring systems can also be problematic. For example, in high voltage applications, high voltage tension can be generated at the input receptacle of the X-ray tube, which can unload to internal wiring and cause the wiring to short. The wiring used for a grid voltage supply or for a filament voltage supply can experience defects, or shorts, as a result of the high voltage tension. Such defects can cause the X-ray tube, and a monitoring system to which the X-ray tube may be coupled, to operate inaccurately and malfunction.

An improved X-ray tube is described herein. The X-ray tube described herein can provide more reliable operational data of the X-ray tube and can reduce or eliminate the incidence of defects or malfunctions within the X-ray tube due to high voltage tension at the supply side of X-ray tube. The X-ray tube described herein can include a connector configured within an input receptacle of the X-ray tube. The connector an include one or more circuits configured to receive an input signal and to generate an output signal indicative of an operational characteristic of the X-ray tube.

Figure 1:
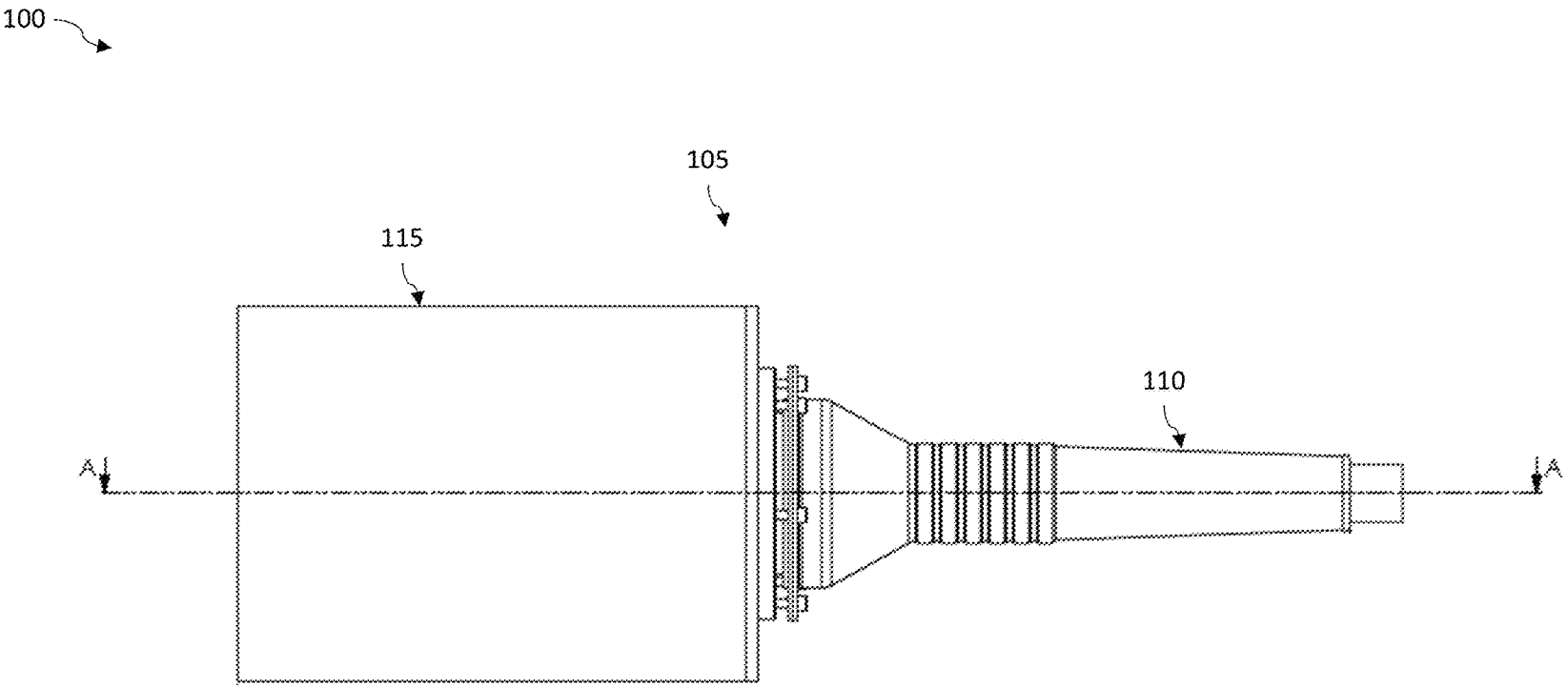
FIG. 1 is a diagram illustrating an example X-ray tube according to some implementations of the current subject matter.

FIG. 1 is a diagram 100 illustrating an example X-ray tube 105 according to some implementations of the current subject matter. The X-ray tube 105 can include an input receptacle 110 coupled to a tube 115. In some embodiments, the X-ray tube 105 can be an open tube or a closed tube. The input receptacle 110 can couple a voltage generator to the tube 105 so as to provide a voltage supply to a cathode configured within the tube 115. In some embodiments, the X-ray tube 105 can be a monopolar X-ray tube 105 in which a cathode is configured to receive the voltage supply. In some embodiments, the X-ray tube 105 can be a bipolar X-ray tube 105 in which the cathode and an anode can be configured to receive the voltage supply. The voltage supply provided to the X-ray tube 105 via the input receptacle 110 can be a high voltage supply between 20 kV and 400 kV. For example, the voltage supplied to the X-ray tube 105 can be supplied at a voltage of 160 kV, 180 kV, 240 kV, 300 kV, or 350 kV.

Figure 2:
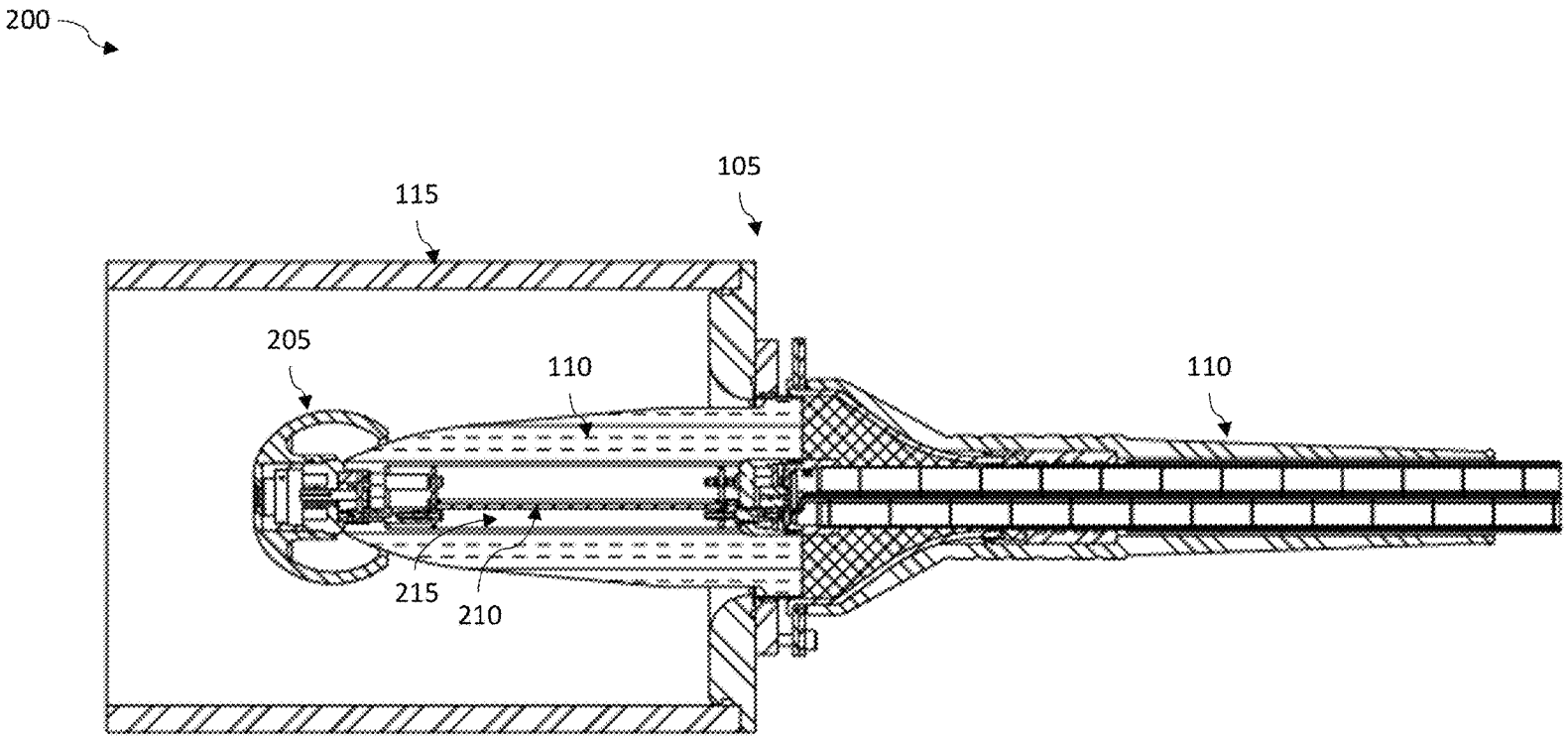
FIG. 2 is a diagram illustrating a cross-sectional view of the X-ray tube of FIG. 1 including a connector configured therein according to some implementations of the current subject matter.

FIG. 2 is a diagram 200 illustrating a cross-sectional view of the X-ray tube 105 of FIG. 1 including a connector configured therein according to some implementations of the current subject matter. The cross-sectional view shown in FIG. 2 is shown from the perspective of lines A-A shown in FIG. 1. The X-ray tube 105 can include a cathode 205. The cathode 205 can coupled to the input receptacle 110 via a connector 210. In some embodiments, the connector 210 can couple the input receptacle 110 to a cathode and to an anode of the X-ray tube 105. In some embodiments, the connector 210 can couple the input receptacle 110 to a high voltage feedthrough configured within the input receptacle 110. The connector 210 can located within an open space 215 within the input receptacle 110. The open space 215 can be configured to allow the connector 210 to be inserted into and/or removed from within the open space 215. The connector 210 can be advantageously flat-shaped and can be maintenance free to allow electronics to be configured on the connector 210 without changing the shape of the open space 215 of the input receptacle 110.

The connector 210 can include electronic circuitry configured to determine operational characteristics of the X-ray tube 105. For example, the connector 210 can include a printed circuit board. One or more circuits can be configured on the connector 210 to receive an input signal and to generate an output signal indicative of an operational characteristic of the X-ray tube. For example, the operational characteristics can include a tube-type identifier, a filament temperature, a filament current, an electron emission current, or at least one parameter associated with a beam shape emitted by the X-ray tube 105.

Figure 3:
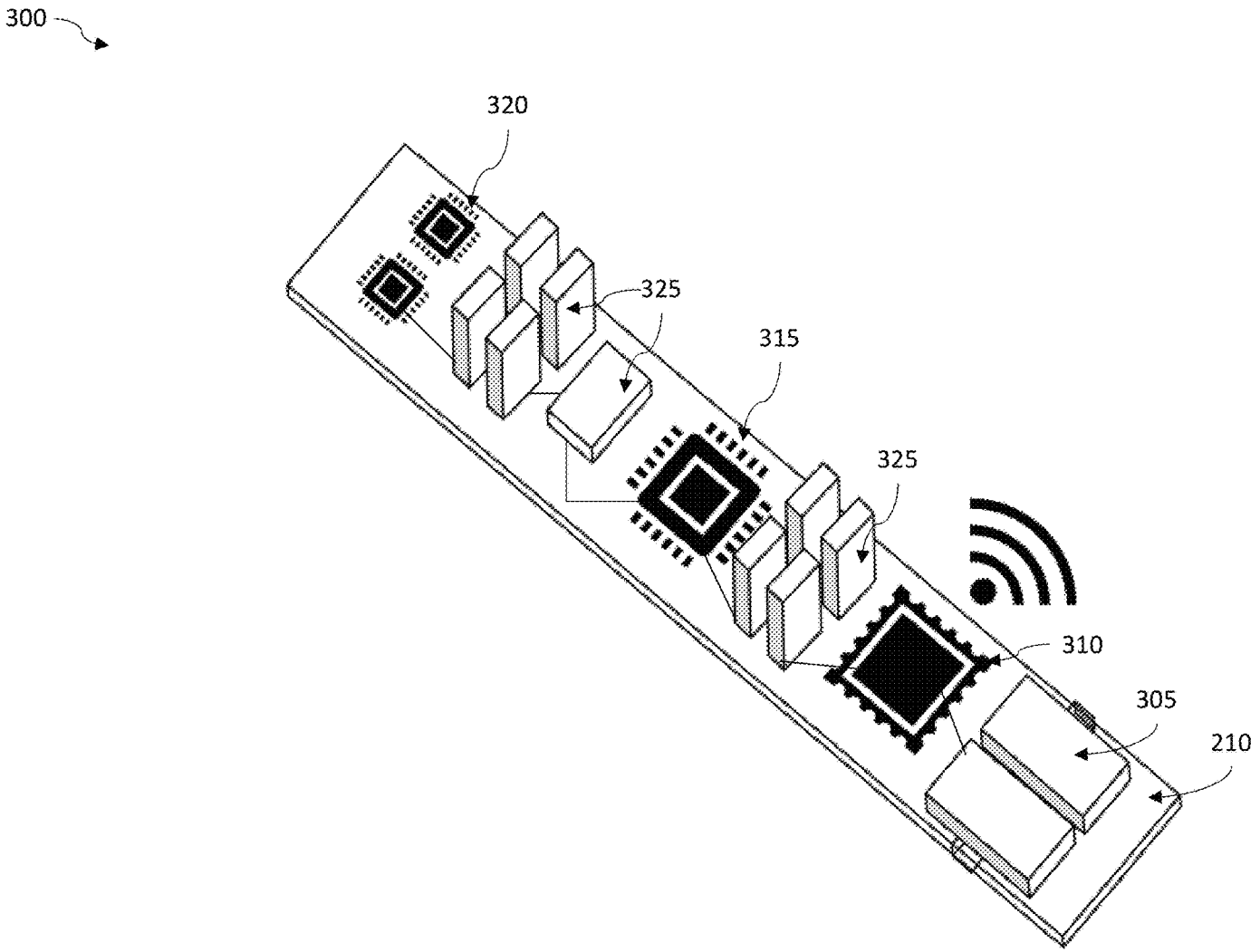
FIG. 3 is a diagram illustrating circuitry and components configured on a connector included in the X-ray tube of FIG. 1 according to some implementations of the current subject matter.

FIG. 3 is a diagram 300 illustrating circuitry and components configured on a connector 210 included in the X-ray tube 105 of FIGS. 1-2 according to some implementations of the current subject matter. As shown in FIG. 3, the connector 210 can be configured with a number of electrical components and circuitry to providing a telemetric sub-system by which data characterizing operational characteristics of the X-ray tube 105 can be generated.

For example, the connector 210 can include one or more supply voltage transformers 305. The connector 210 can also include at least one communication transceiver 310. The communication transceiver 310 can be configured as a wireless communication transceiver 310 as shown in FIG. 3, or in some embodiments, the transceiver 310 can be a wired transceiver. The connector 210 can also include one or more data processors 315. The connector 210 can further include one or more sensors 320. In some embodiments, the sensors 320 can include a filament temperature sensor, a filament current sensor, an electron emission current sensor, or a beam shape sensor. The connector 210 can also include capacitors, inductors, and resistors 325 configured to support the circuits configured on the connector 210.

In some embodiments, the connector 210 can include a printed circuit board and the electrical components and circuitry described above can be configured on the connector 210 via the printed circuit board.

Figure 4:
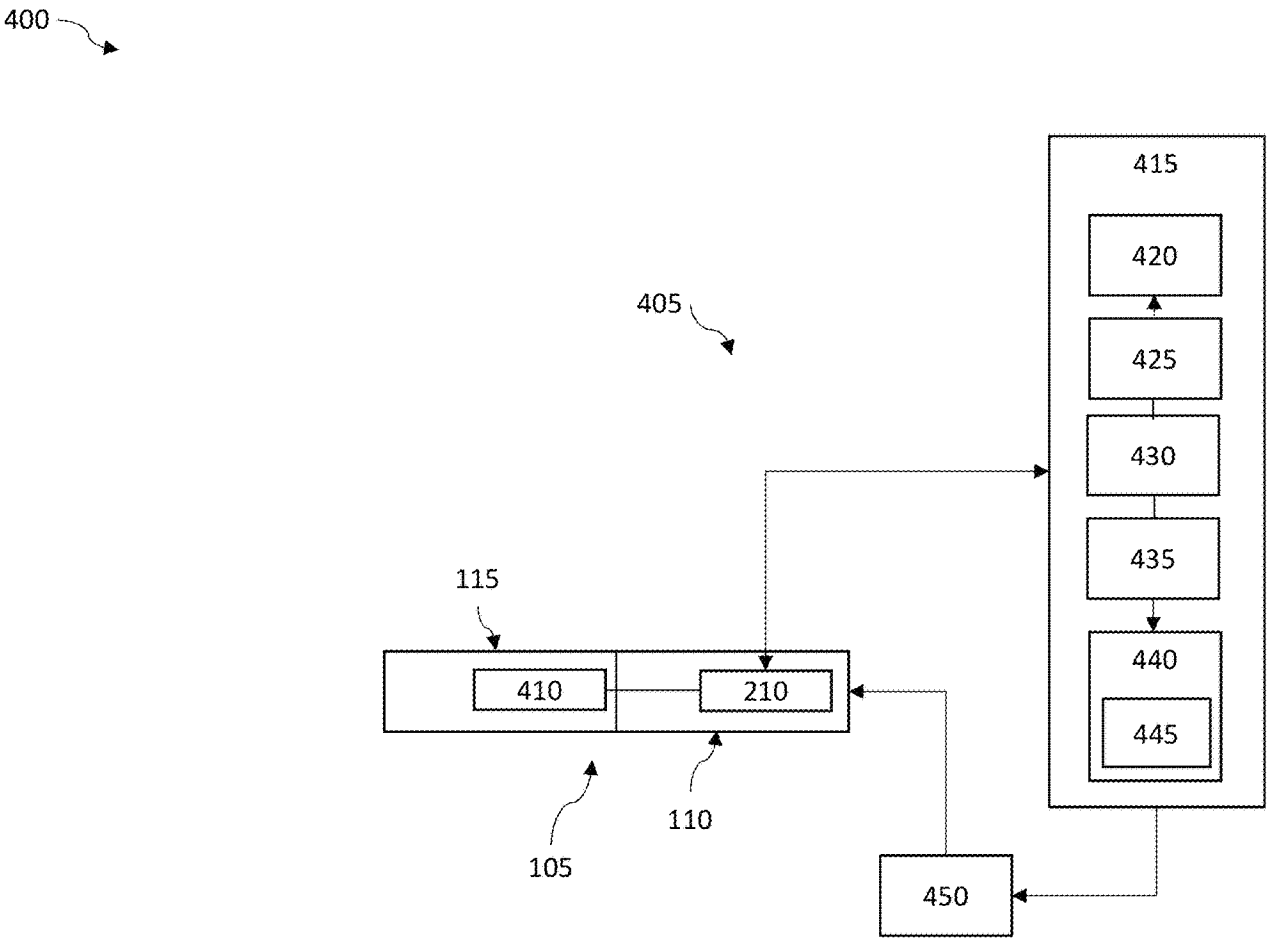
FIG. 4 is a diagram illustrating an example system including the X-ray tube of FIG. 1 according to some implementations of the current subject matter.

FIG. 4 is a block diagram 400 illustrating an example system 405 including a monopolar X-ray tube 105 according to some implementations of the current subject matter. As shown in FIG. 4, the connector 210 can be coupled to a cathode 410 of the X-ray tube 105. As further shown in FIG. 4, a computing device 415 can be communicatively coupled to the connector 210 of the X-ray tube 105. The computing device 415 can include multiple-interconnected components, such as a processor 420, a memory 425, a controller 430, a communication transceiver 435, and a display 440. The display 440 can include a graphical user interface (GUI) 445.

Figure 6:
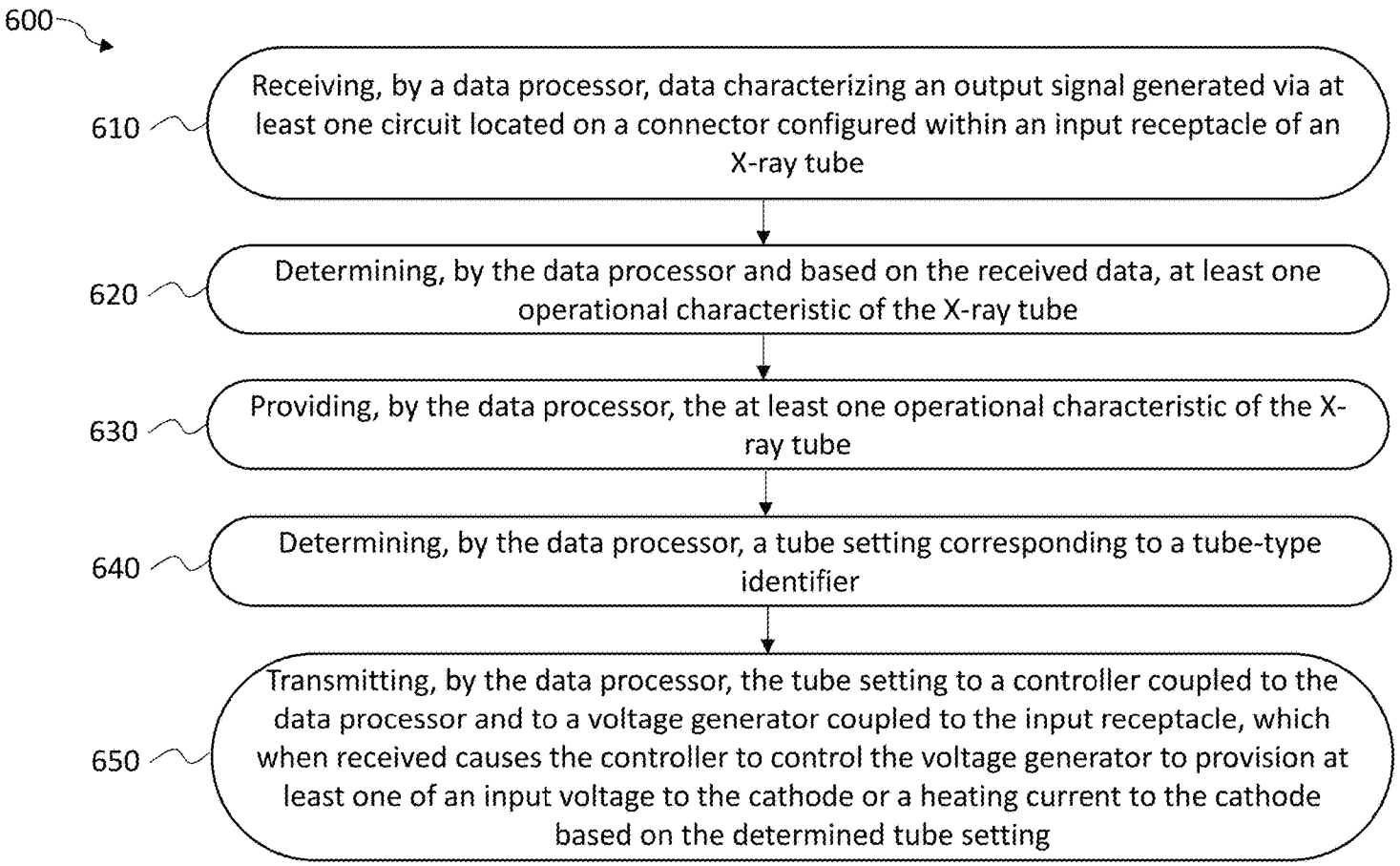
FIG. 6 is a process flow diagram illustrating an example process of operating the system of FIG. 1 according to some implementations of the current subject matter.

The processor 420 can be configured to execute computer-readable instructions stored the memory 425 to perform the methods described in relation to FIG. 6. The memory 425 can further store one or more tube settings and/or tube-type identifier settings associated with the X-ray tube 105. The processor 420 can also execute computer-readable instructions stored in the memory 425, which cause the processor 420 to control operations of a voltage generator 450 via the controller 430. In this way, the controller 430 can control an operation of the voltage generator 450 to supply an input signal to the cathode 410 of the X-ray tube 105. The communication transceiver 435 can include a wired or a wireless transceiver configured to establish a communication channel with the connector 210 via the transceiver 310 configured with respect to the connector 210.

As shown in FIG. 4, the computing device 415 includes a display 440 configured with a GUI 445. The GUI 445 can display operational characteristics of the X-ray tube 105 to a user. In some embodiments, the GUI 445 can display one or more alarms or notifications based on the operational characteristic. In some embodiments, the alarm can cause the controller 430 to modify an operation of the voltage generator 450 and the input signal provided to the cathode 410 of the X-ray tube 105.

Figure 5:
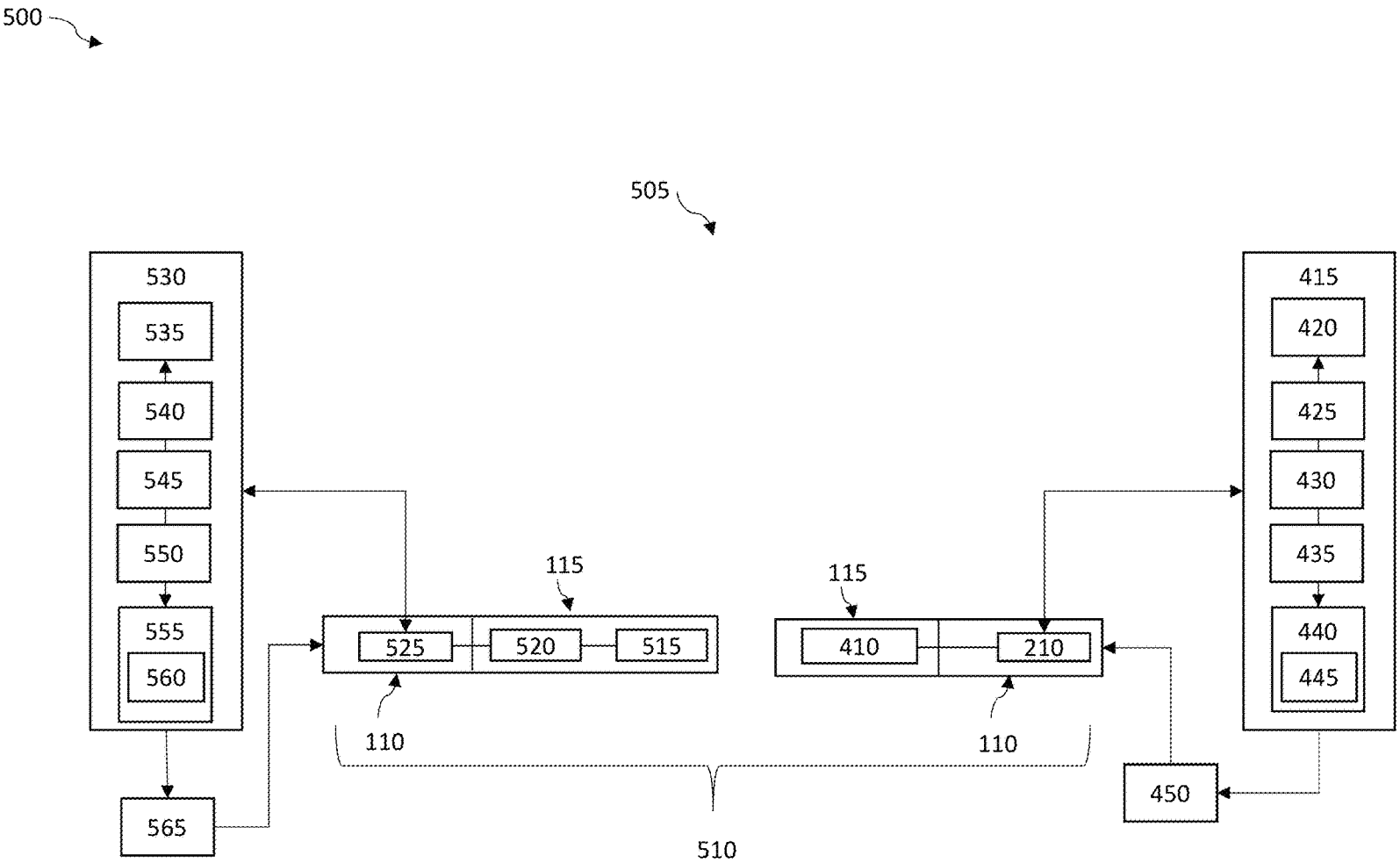
FIG. 5 is a block diagram illustrating an example system including a bipolar X-ray tube according to some implementations of the current subject matter.

FIG. 5 is a block diagram 500 illustrating an example system 505 including a bipolar X-ray tube 510 according to some implementations of the current subject matter. As shown in FIG. 5, the bipolar X-ray tube 510 can include a cathode 410 as described in relation to FIG. 4 and an anode 515 coupled to a motor 520. The motor 520 can rotate the anode 515 to distribute energy from the cathode 410 on a larger surface area of the anode 515. The motor 520 can be coupled to the connector 525. In some embodiments, the connector 525 can include a microcontroller coupled to the motor 520 and configured to control a rotation speed and power conversion of the motor 520. In some embodiments, the microcontroller can be configured separately from the connector 525. The connector 525 can correspond to the connector 210 described in relation to FIGS. 2 and 3.

As further shown in FIG. 5, a second computing device 530 can be communicatively coupled to the anode 515 via the connector 525 of the bipolar X-ray tube 510. In some embodiments, the X-ray tube 510 can include a single connector (210 or 525), which can be coupled to the cathode 410 and to the anode 515. In this embodiment, a single voltage generator (450 or 565) can be coupled to a single computing device (415 or 530) to provide an input signal to the cathode 410 and to the anode 515 via the connector 210 or 525.

As shown in FIG. 5, the second computing device 530 can be communicatively coupled to the anode 515 via a second connector 525 of the bipolar X-ray tube 510. The computing device 530 can include multiple-interconnected components, such as a processor 535, a memory 540, a controller 545, a communication transceiver 550, and a display 555. The display 555 can include a graphical user interface (GUI) 560.

The processor 535 can be configured to execute computer-readable instructions stored the memory 540 to perform the methods described in relation to FIG. 6 with respect to the anode 515 instead of the cathode 410. The memory 540 can further store one or more tube settings and/or tube-type identifier settings associated with the bipolar X-ray tube 510. The processor 535 can also execute computer-readable instructions stored in the memory 540, which cause the processor 535 to control operations of a voltage generator 565 via the controller 545. In this way, the controller 545 can control an operation of the voltage generator 565 to supply an input signal to the anode 515 of the bipolar X-ray tube 510. The communication transceiver 550 can include a wired or a wireless transceiver configured to establish a communication channel with the connector 525.

As shown in FIG. 5, the computing device 530 includes a display 555 configured with a GUI 560. The GUI 560 can display operational characteristics of the bipolar X-ray tube 510 to a user. In some embodiments, the GUI 560 can display one or more alarms or notifications based on the operational characteristic. In some embodiments, the alarm can cause the controller 545 to modify an operation of the voltage generator 565 and the input signal provided to the anode 515 of the bipolar X-ray tube 510.

FIG. 6 is a process flow diagram illustrating an example process 600 of operating the system 405 of FIG. 4 or the system 505 of FIG. 5 according to some implementations of the current subject matter. In operation 610, the data processor 420,535 can receive data characterizing an output signal generated via at least one circuit located on a connector 410, 525 configured within an input receptacle 110 of an X-ray tube 105, 510.

In operation 620, the data processor 420, 535 can determine, based on the received data, at least one operational characteristic of the X-ray tube 105, 510. For example, the data processor can determine that the operational characteristic is one of a tube-type identifier, a filament temperature, a filament current, an electron emission current, or at least one parameter associated with a beam shape emitted by the X-ray tube. In operation 630, the data processor 420, 535 can provide the at least one operational characteristic. For example, the data processor 420, 535 can provide the operational characteristic via a display 445, 560.

Responsive to providing a tube-type identifier as the operational characteristic, the data processor 420, 535 can further determine a tube setting corresponding to the tube-type identifier in operation 640. In response, in operation 650, the data processor 420, 535 can transmit the tube-setting to a controller 430, 545 coupled to the data processor 420, 535 and to a voltage generator coupled to the input receptacle 110, such as the voltage generator 450, 565 shown in FIG. 5. Once received, the controller 430, 545 can control the voltage generator 450, 565 to provide an input voltage to the cathode 410, an input voltage to the anode 515, or a heating current to the cathode 410, based on the determined tube setting. In some embodiments, the controller 545 can control the voltage generator 565 to provide an input voltage to a microcontroller coupled to the motor 520 and/or to the motor 520 itself directly. The input voltage can be provided to the input receptacle as an auxiliary supply voltage.

Exemplary technical effects of the apparatus, systems, and methods described herein include, by way of non-limiting example, determining an operational characteristic of an X-ray tube using a maintenance free connector configured within the input receptacle of the X-ray tube. The operational characteristic can be used by a system in which the X-ray tube is included to control an input signal or input voltage supplied to the input receptacle from a voltage generator. Determining the operational characteristics of the X-ray as described herein can enable operational diagnosis and monitoring of the X-ray tube for a wide variety of applications. For example, determining the operational characteristic of the X-ray tube can be used to monitor filament temperature, filament current, electron emission current, tube-types, and beam shape parameters of the X-ray tube. The X-ray tube system configured to perform the methods described herein can provide more accurate diagnosis of operational faults or malfunctions and thus enable more robust operation of X-ray tubes. The X-ray system described herein can also include improved interfaces for providing an integrity state. Further, the X-ray tube system can cause a change in operation of the X-ray tube based on the determined operational characteristic which can ensure the X-ray tube operates within acceptable or safe operating parameters.

Certain exemplary embodiments have been described to provide an overall understanding of the principles of the structure, function, manufacture, and use of the systems, devices, and methods disclosed herein. One or more examples of these embodiments have been illustrated in the accompanying drawings. Those skilled in the art will understand that the systems, devices, and methods specifically described herein and illustrated in the accompanying drawings are non-limiting exemplary embodiments and that the scope of the present invention is defined solely by the claims. The features illustrated or described in connection with one exemplary embodiment can be combined with the features of other embodiments. Such modifications and variations are intended to be included within the scope of the present invention. Further, in the present disclosure, like-named components of the embodiments generally have similar features, and thus within a particular embodiment each feature of each like-named component is not necessarily fully elaborated upon.

The subject matter described herein can be implemented in analog electronic circuitry, digital electronic circuitry, and/or in computer software, firmware, or hardware, including the structural means disclosed in this specification and structural equivalents thereof, or in combinations of them. The subject matter described herein can be implemented as one or more computer program products, such as one or more computer programs tangibly embodied in an information carrier (e.g., in a machine-readable storage device), or embodied in a propagated signal, for execution by, or to control the operation of, data processing apparatus (e.g., a programmable processor, a computer, or multiple computers). A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification, including the method steps of the subject matter described herein, can be performed by one or more programmable processors executing one or more computer programs to perform functions of the subject matter described herein by operating on input data and generating output. The processes and logic flows can also be performed by, and apparatus of the subject matter described herein can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processor of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, and flash memory devices); magnetic disks, (e.g., internal hard disks or removable disks); magneto-optical disks; and optical disks (e.g., CD and DVD disks). The processor and the memory can be supplemented by, or incorporated in, special purpose logic circuitry.

To provide for interaction with a user, the subject matter described herein can be implemented on a computer having a display device, e.g., a CRT (cathode ray tube) or LCD (liquid crystal display) monitor, for displaying information to the user and a keyboard and a pointing device, (e.g., a mouse or a trackball), by which the user can provide input to the computer. Other kinds of devices can be used to provide for interaction with a user as well. For example, feedback provided to the user can be any form of sensory feedback, (e.g., visual feedback, auditory feedback, or tactile feedback), and input from the user can be received in any form, including acoustic, speech, or tactile input.

The techniques described herein can be implemented using one or more modules. As used herein, the term "module" refers to computing software, firmware, hardware, and/or various combinations thereof. At a minimum, however, modules are not to be interpreted as software that is not implemented on hardware, firmware, or recorded on a non-transitory processor readable recordable storage medium (i.e., modules are not software per se). Indeed "module" is to be interpreted to always include at least some physical, non-transitory hardware such as a part of a processor or computer. Two different modules can share the same physical hardware (e.g., two different modules can use the same processor and network interface). The modules described herein can be combined, integrated, separated, and/or duplicated to support various applications. Also, a function described herein as being performed at a particular module can be performed at one or more other modules and/or by one or more other devices instead of or in addition to the function performed at the particular module. Further, the modules can be implemented across multiple devices and/or other components local or remote to one another. Additionally, the modules can be moved from one device and added to another device, and/or can be included in both devices.

The subject matter described herein can be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected by any form or medium of digital data communication, e.g., a communication network. Examples of communication networks include a local area network ("LAN") and a wide area network ("WAN"), e.g., the Internet.

Approximating language, as used herein throughout the specification and claims, can be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language can correspond to the precision of an instrument for measuring the value. Here and throughout the specification and claims, range limitations can be combined and/or interchanged, such ranges are identified and include all the sub-ranges contained therein unless context or language indicates otherwise.

One skilled in the art will appreciate further features and advantages of the invention based on the above-described embodiments. Accordingly, the present application is not to be limited by what has been particularly shown and described, except as indicated by the appended claims. All publications and references cited herein are expressly incorporated by reference in their entirety.

The invention claimed is:

1. An apparatus comprising:
an X-ray tube including
a cathode; and
an input receptacle coupled to the cathode, the input receptacle including
a connector configured within the input receptacle and operatively coupling the cathode and the input receptacle, the connector including
at least one circuit configured to receive an input signal via the input receptacle, the input signal received as an auxiliary supply voltage, and to generate an output signal indicative of at least one operational characteristic of the X-ray tube, and
a transceiver configured to establish a communication channel between the connector and a data processor of a computing device coupled to the connector via the communication channel, wherein the transceiver is powered by a portion of the auxiliary supply voltage.

2. The apparatus of claim 1, wherein the connector is configured for insertion into and removal from an inner volume of the input receptacle.

3. The apparatus of claim 1, wherein the X-ray tube is a bipolar X-ray tube.

4. The apparatus of claim 1, wherein the at least one operational characteristic of the X-ray tube includes a filament temperature, a filament current, an electron emission current, or at least one parameter associated with a beam shape emitted by the X-ray tube.

5. The apparatus of claim 1, wherein the data processor is configured to determine a tube setting associated with the at least one operational characteristic of the X-ray tube, the tube setting corresponding to a tube-identifier setting stored in a memory of the computing device, wherein the data processor is further configured to transmit the determined setting to a controller coupled to the data processor and to a voltage generator coupled to the input receptacle, which causes the controller to control the voltage generator to provide at least one of an input voltage to the cathode or a heating current to the cathode based on the determined setting of the X-ray tube.

6. The apparatus of claim 1, wherein the input signal is between 20 kV and 400 kV.

7. A system comprising:
an X-ray tube including
a cathode;
an input receptacle coupled to the cathode, the input receptacle including
a connector configured within the input receptacle and operatively coupling the cathode and the input receptacle, the connector including
at least one circuit configured to receive an input signal via the input receptacle, the input signal received as an auxiliary supply voltage and to generate an output signal indicative of at least one operational characteristic of the X-ray tube, and
a transceiver configured to transmit the output signal generated via the at least one circuit; and
a computing device operatively coupled to the connector via a communication channel established by the transceiver, the computing device comprising at least one data processor; and a memory storing instructions, which when executed by the at least one data processor causes the at least one data processor to perform operations comprising
receiving data characterizing the output signal,
determining, based on the received data, the at least one operational characteristic of the X-ray tube; and
providing the at least one operational characteristic of the X-ray tube.

8. The system of claim 7, wherein the transceiver is powered by a portion of the auxiliary supply voltage.

9. The system of claim 7, wherein the at least one operational characteristic of the X-ray tube includes a filament temperature, a filament current, an electron emission current, or at least one parameter associated with a beam shape emitted by the X-ray tube.

10. The system of claim 7, wherein the at least one operational characteristic is provided in a graphical user interface of a display coupled to the data processor.

11. The system of claim 7, wherein the input signal is between 20 kV and 400 kV.

12. A method comprising:
receiving, by a data processor, data characterizing an output signal generated via at least one circuit located on a connector configured within an input receptacle of an X-ray tube, the connector operatively coupling a cathode of the X-ray tube to the input receptacle and comprising a transceiver configured to establish a communication channel communicably coupling the connector and the data processor, wherein the transceiver is powered by a portion of an auxiliary supply voltage, the at least one circuit configured to receive an input signal via the input receptacle, the input signal received as the auxiliary supply voltage, and to generate the output signal indicative of at least one operational characteristic of the X-ray tube;

determining, by the data processor and based on the received data, the at least one operational characteristic of the X-ray tube; and providing, by the data processor, the at least one operational characteristic of the X-ray tube.

13. The method of claim 12, wherein the connector is configured for insertion into and removal from an inner volume of the input receptacle.

14. The method of claim 12, wherein the X-ray tube is a bipolar X-ray tube.

15. The method of claim 12, wherein the at least one operational characteristic of the X-ray tube includes a filament temperature, a filament current, an electron emission current, or at least one parameter associated with a beam shape emitted by the X-ray tube.

16. The method of claim 12, wherein responsive to providing the at least one operational characteristic indicative of a tube-type identifier corresponding to a type of X-ray tube, the method further comprises determining, by the data processor, a tube setting corresponding to the tube-type identifier; and transmitting, by the data processor, the tube setting to a controller coupled to the data processor and to a voltage generator coupled to the input receptacle, which when received, causes the controller to control the voltage generator to provision at least one of an input voltage to the cathode or a heating current to the cathode based on the determined tube setting.

17. The method of claim 12, wherein the input signal is between 20 kV and 400 kV.

18. The method of claim 12, wherein the at least one operational characteristic is provided in a graphical user interface provided in a display coupled to the data processor.

* * * * *